US010196915B2

(12) United States Patent
Thornton

(10) Patent No.: US 10,196,915 B2
(45) Date of Patent: Feb. 5, 2019

(54) TRAILING EDGE PLATFORM SEALS

(71) Applicant: UNITED TECHNOLOGIES CORPORATION, Farmington, CT (US)

(72) Inventor: Lane Thornton, Meriden, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 341 days.

(21) Appl. No.: 14/726,722

(22) Filed: Jun. 1, 2015

(65) Prior Publication Data

US 2016/0348525 A1 Dec. 1, 2016

(51) Int. Cl.
*F01D 11/00* (2006.01)
*F01D 5/22* (2006.01)
*F01D 5/14* (2006.01)

(52) U.S. Cl.
CPC ..... *F01D 11/006* (2013.01); *F01D 5/147* (2013.01); *F01D 5/22* (2013.01); *F01D 5/225* (2013.01); *F01D 11/00* (2013.01); *F01D 11/005* (2013.01); *F01D 11/008* (2013.01); *F05D 2220/32* (2013.01); *F05D 2240/55* (2013.01); *F05D 2240/80* (2013.01); *F05D 2260/941* (2013.01); *F05D 2300/173* (2013.01); *F05D 2300/174* (2013.01); *F05D 2300/177* (2013.01)

(58) Field of Classification Search
CPC .... F05D 2240/55; F05D 2240/80; F01D 5/22; F01D 5/28; F01D 11/005; F01D 11/006
See application file for complete search history.

(56) References Cited

U.S. PATENT DOCUMENTS 4,580,946 A * 4/1986 Bobo ..... F01D 5/22 416/190
4,872,810 A * 10/1989 Brown ..... F01D 5/22 416/145
5,513,955 A * 5/1996 Barcza ..... F01D 11/006 416/193 A
5,957,658 A 9/1999 Kasprow et al.
6,171,058 B1 * 1/2001 Stec ..... F01D 5/22 416/193 A
7,762,780 B2 * 7/2010 Decardenas ..... F01D 5/147 416/193 A (Continued)

FOREIGN PATENT DOCUMENTS

EP 0851097 A2 7/1998
EP 1380726 A2 1/2004

(Continued)

OTHER PUBLICATIONS

European Search Report for Application No. EP 16 17 1833.
Official Communication from the European Patent Office for Application 16171833.3 dated Sep. 14, 2018, 5 pages.

*Primary Examiner* — Ninh H Nguyen
(74) *Attorney, Agent, or Firm* — Cantor Colburn LLP

(57) ABSTRACT

A platform trailing edge seal for a turbomachine airfoil (e.g., a blade or vane) assembly includes a body configured to extend into an aft portion of a mateface gap defined between a circumferentially adjacent pair of turbomachine airfoil platforms to minimize flow from entering a blade-vane cavity through the aft portion of the mateface gap.

16 Claims, 5 Drawing Sheets

(56) References Cited

U.S. PATENT DOCUMENTS

| | | | | |
|---|---|---|---|---|
| 8,011,892 | B2 * | 9/2011 | Ramlogan | F01D 5/22 416/190 |
| 2004/0179937 | A1 * | 9/2004 | Kreis | F01D 5/22 415/170.1 |
| 2012/0049467 | A1 * | 3/2012 | Stewart | F01D 5/22 277/641 |
| 2016/0222800 | A1 * | 8/2016 | Kleinow | F01D 5/22 |

FOREIGN PATENT DOCUMENTS

| | | | |
|---|---|---|---|
| EP | 2093381 | A1 | 8/2009 |
| EP | 2679770 | A1 | 1/2014 |

* cited by examiner

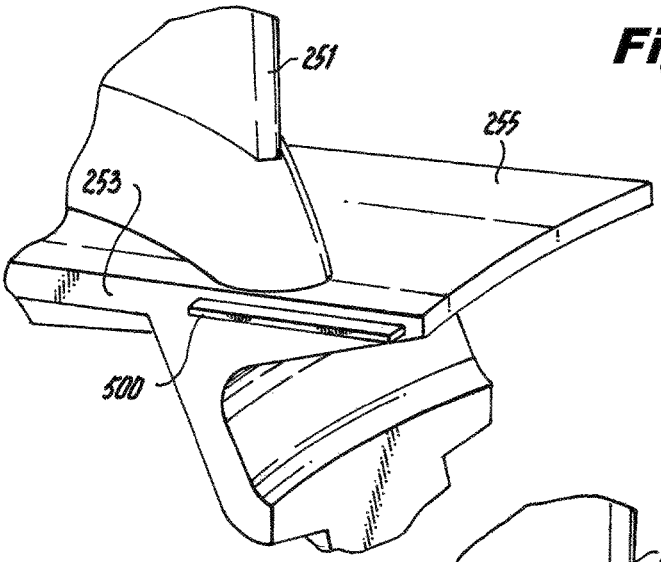
Fig. 5A
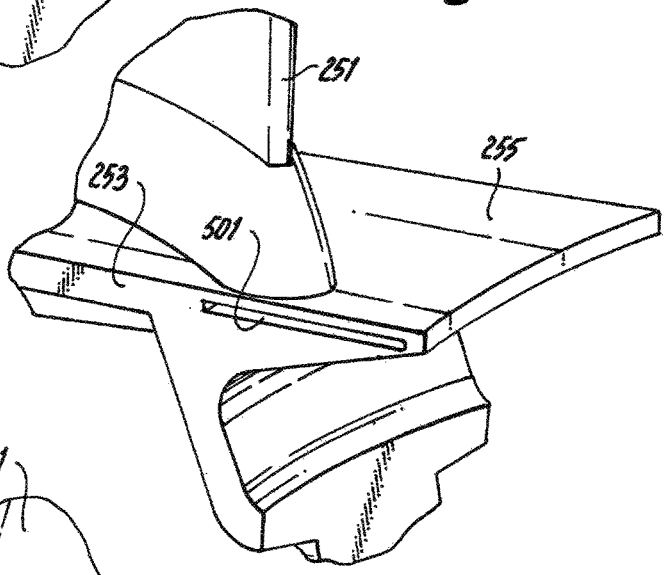
Fig. 5B
Fig. 5C
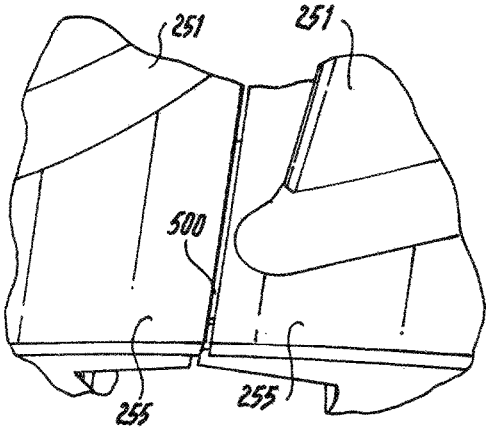

TRAILING EDGE PLATFORM SEALS

BACKGROUND

1. Field

The present disclosure relates to turbomachine seals, more specifically to seals for turbomachine blades.

2. Description of Related Art

Traditional commercial engines can experience gaspath ingestion into a blade-vane cavity through a mateface gap between platform trailing edges of blades. While a cooling flow is generally provided through the blade-vane gap, it can be insufficient to prevent the hot flow from traveling through the mateface gap between the blades.

Ingestion in this region can cause the durability of the certain components to decrease. Certain remedies for this issue can be costly, e.g., in terms of flow (which impacts engine trust specific fuel consumption directly through cycle penalties and indirectly through turbine efficiency losses).

Such conventional methods and systems have generally been considered satisfactory for their intended purpose. However, there is still a need in the art for improved thermal regulation and flow sealing systems. The present disclosure provides a solution for this need.

SUMMARY

A platform trailing edge seal for a turbomachine airfoil (e.g., a blade or vane) assembly includes a body configured to extend into an aft portion of a mateface gap defined between a circumferentially adjacent pair of turbomachine airfoil platforms to minimize flow from entering a blade-vane cavity through the aft portion of the mateface gap. The body of the seal can include at least one of aluminum, titanium, nickel, or any other suitable material.

The body can be shaped to match a platform trailing edge shape. In certain embodiments, the body can be annular (e.g., full hoop). It is contemplated that the body can define a segment of an annular structure.

In accordance with at least one aspect of this disclosure, a turbomachine blade assembly can include a blade having a blade platform which defines a platform trailing edge, and a platform trailing edge seal as described above extending from the trailing edge portion. As described above, the body of the seal can be configured to extend into an aft portion of a mateface gap defined between the blade platform and an adjacent blade platform to minimize flow from entering a blade-vane cavity through the aft portion of the mateface gap.

In certain embodiments, the platform trailing edge seal can be formed integrally with the platform trailing edge. In other embodiments, the platform trailing edge seal can be attached to the platform trailing edge.

The blade can be located in one of a low pressure compressor, a high pressure compressor, a low pressure turbine, or a high pressure turbine. The blade platform can include one or more protrusions for securing the platform trailing edge seal to the blade platform. In certain embodiments, the platform trailing edge seal can be friction fit, thermally fit, and/or expansion fit to the blade platform. The assembly can include one or more retaining features attached to the blade platform and configured to retain the platform trailing edge seal to the blade platform.

In accordance with at least one aspect of this disclosure, a turbomachine includes a turbomachine blade assembly as described above.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 5A is a side perspective view of an embodiment of an assembly in accordance with this disclosure, showing a platform trailing edge seal disposed in a blade platform trailing edge;

FIG. 5B is a side perspective view of the embodiment of FIG. 5A, showing the platform trailing edge seal removed from a slot in the blade platform trailing edge; and FIG. 5C is a top perspective view of the embodiment of FIG. 5A, showing adjacent blade platforms assembled together with the platform trailing edge seal therebetween.

DETAILED DESCRIPTION

Figure 1:
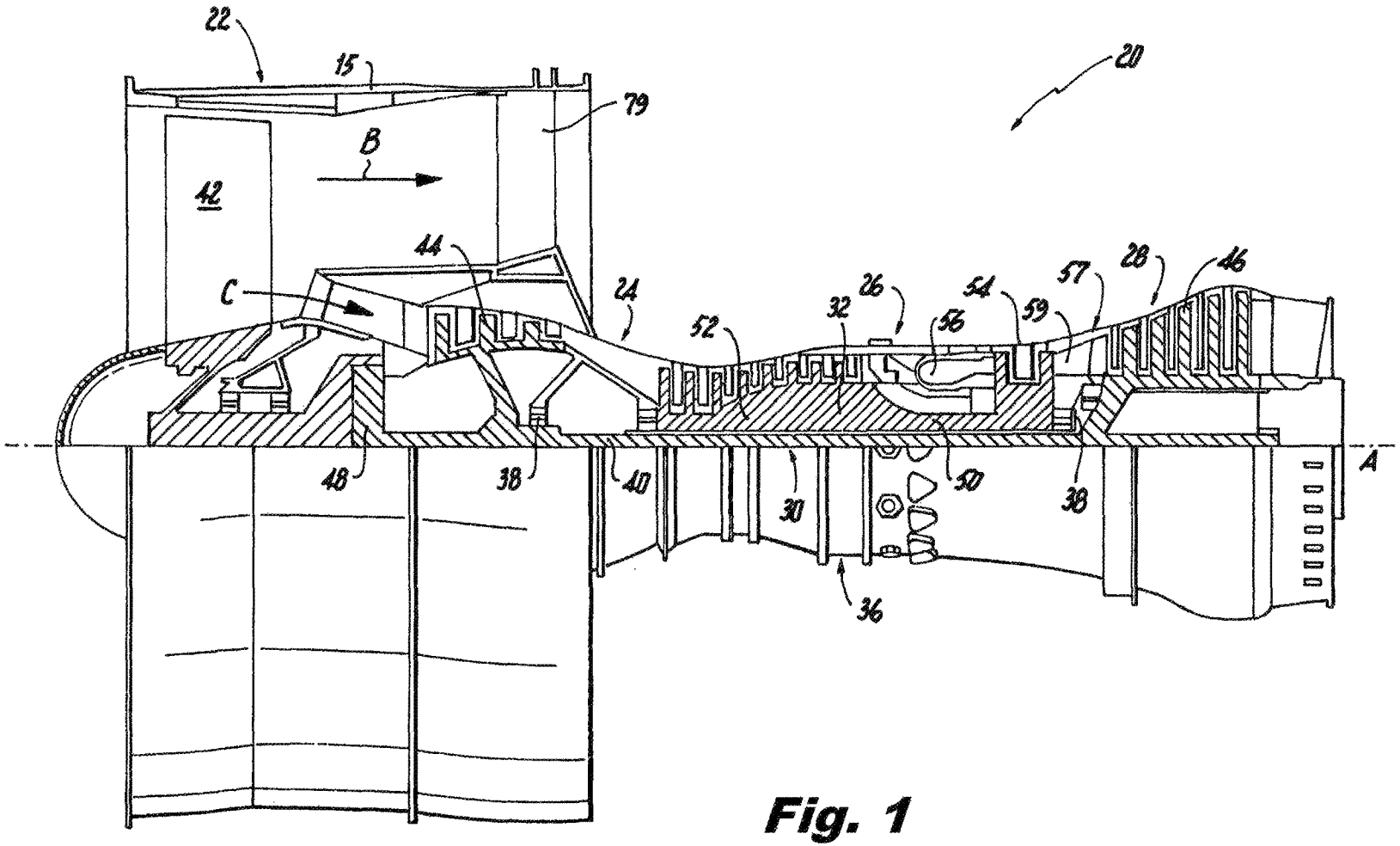
FIG. 1 is a schematic view of a turbomachine in accordance with this disclosure.

Reference will now be made to the drawings wherein like reference numerals identify similar structural features or aspects of the subject disclosure. For purposes of explanation and illustration, and not limitation, an illustrative view of an embodiment of a seal 200 and assembly 250 in accordance with the disclosure is shown in FIG. 2A. Other embodiments and/or aspects of this disclosure are shown in FIGS. 1 and 2A-5C. The systems and methods described herein can be used to improve the operating efficiency of a turbomachine.

Figure 2A:
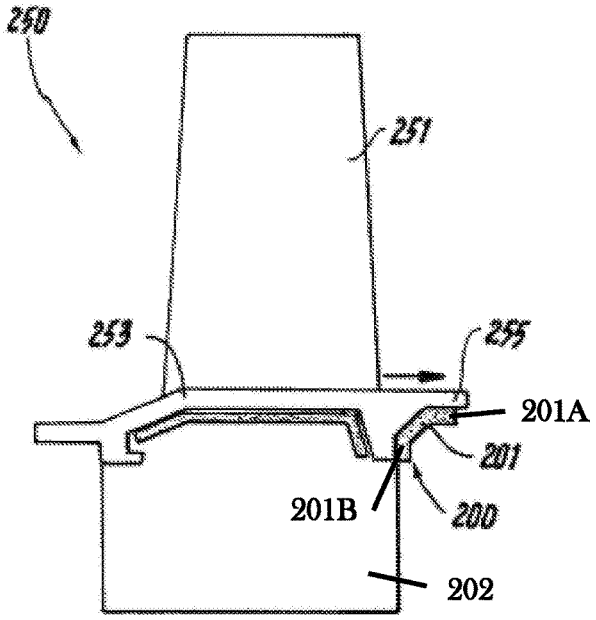
FIG. 2A is a cross-sectional elevation view of an embodiment of an assembly in accordance with this disclosure, showing a platform trailing edge seal disposed under a blade platform trailing edge.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a gear system 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition~typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane 79("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 2B:
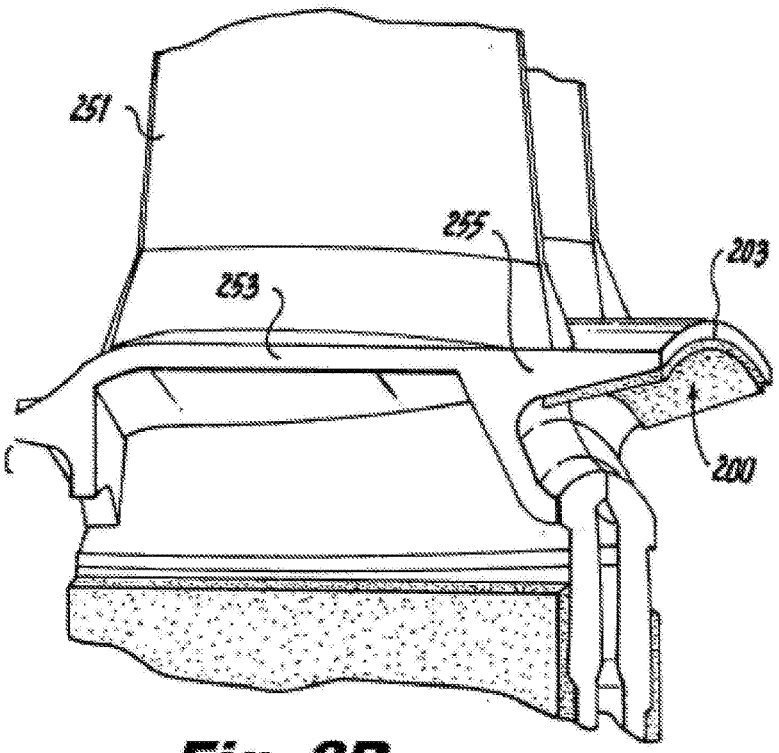
FIG. 2B is a side perspective view of the embodiment of FIG. 2A.
Figure 2C:
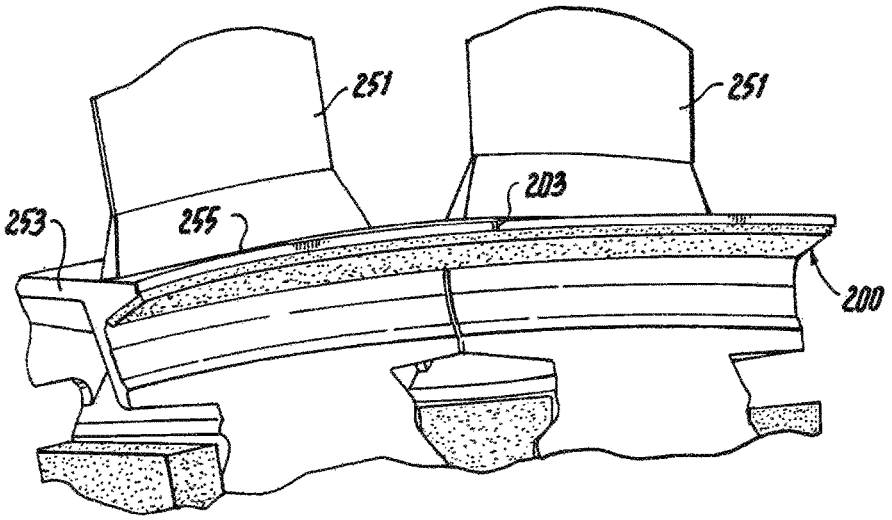
FIG. 2C is a front perspective view of the embodiment of FIG. 2A.
Figure 3:
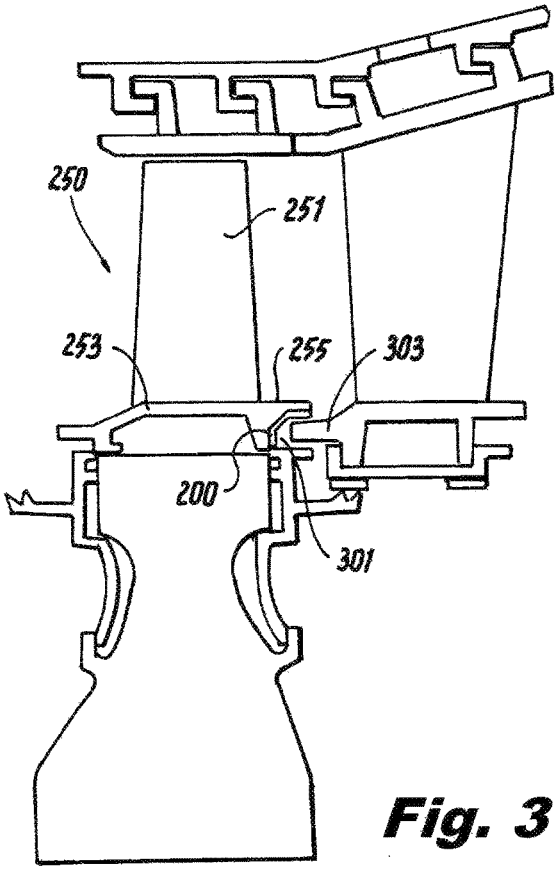
FIG. 3 is a cross-sectional elevation view of the assembly of claim 1, disposed in a turbomachine adjacent a vane.

Referring to FIGS. 2A-3, a platform trailing edge seal 200 for a turbomachine blade assembly 250 includes a body 201 having a first portion 201A configured to extend into an aft portion of a mateface gap 203 defined between a circumferentially adjacent pair of turbomachine blade platforms 253 to minimize flow from entering a blade-vane cavity 301 (e.g., defined between the platform trailing edge 255 and vane platform 303 as shown in FIG. 3) through the aft portion of the mateface gap 203 and having a second portion 201B that extends towards and engages a blade root 202 of a blade of the turbomachine blade assembly 250. The turbomachine blade assembly 250 can include a blade 251 having a blade platform 253 which defines a platform trailing edge portion 255.

The body 201 of the seal 200 can include at least one of aluminum, titanium, nickel, and/or an alloy thereof. However, it is contemplated that the seal 200 can be made with any other suitable material.

As shown, the body 201 can be shaped to match a shape of a platform trailing edge 255. In certain embodiments, the body 201 can be annular (e.g., full hoop). It is contemplated, however, that the body 201 can define a segment of a seal structure (e.g., the seal structure being an annular structure) such that a plurality of the seals 200 can be disposed together to form an entire seal structure.

In certain embodiments, the platform trailing edge seal 200 can be formed integrally with the platform trailing edge 255. In such a case, each seal 200 forms a segment of a seal structure (e.g., and annular structure) such that when a plurality of blade assemblies 250 are placed adjacent to each other each seal 200 reaches across the aft mateface gap 203 and partially into the adjacent blade platform 253 of the adjacent blade assembly 250.

Figure 4A:
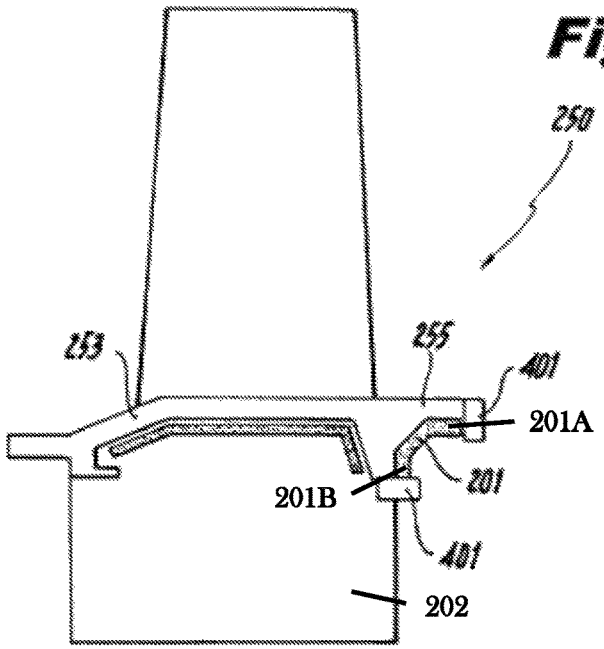
FIG. 4A is a cross-sectional elevation view of another embodiment of an assembly in accordance with this disclosure, showing a platform trailing edge seal disposed under a blade platform trailing edge and retained to the platform using an axial retaining feature and radial retaining feature.
Figure 4B:
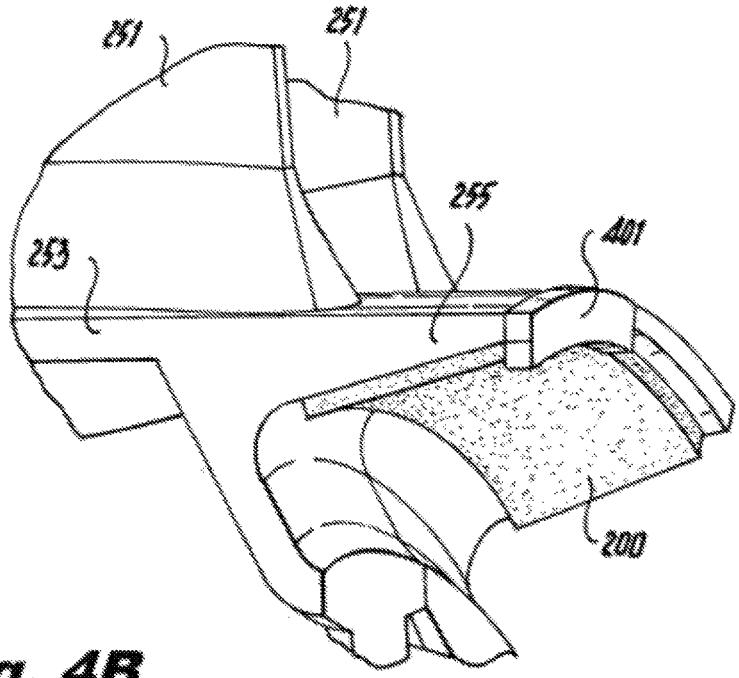
FIG. 4B is a perspective view of the embodiment of FIG. 4A, showing an axial retaining feature disposed thereon.

In other embodiments, the platform trailing edge seal 200 can be attached to the platform trailing edge 255 as a separate piece in any suitable manner. For example, the blade platform 253 can include one or more protrusions for securing the platform trailing edge seal 200 to the blade platform 253. In certain embodiments (e.g., full hoop embodiments), the platform trailing edge seal 200 can be friction fit, thermally fit, and/or expansion fit to the blade platform 253. As shown in FIGS. 4A and 4B, in certain embodiments, the assembly 250 can include one or more retaining features 401 (e.g., a clip) attached to the blade platform 253 at the platform trailing edge 255 and attached to the blade root 202 that are configured to retain the platform trailing edge seal 200 to the blade platform 253. In such an embodiment, the first portion 201A engages a retaining feature 401 that is attached at the platform trailing edge 255 and the second portion 201B engages another retaining feature 401 that is attached to the blade root 202.

Referring to FIG. 5A-5C, another embodiment of a seal 500 is shown disposed therein. As shown seal 500 can be configured as a feather seal to be disposed in a slot 501 that is defined at least partially in the platform trailing edge 255 of platform 253. The slot 501 can be of any suitable length (e.g., at least half as long as the platform trailing edge 253) and can be of any suitable depth. In such embodiments, the seal 500 can be a piece of sheet metal that is dimensioned to span the gap between circumferentially adjacent platforms 253 and/or to seat within corresponding slots 501 in the adjacent platforms.

As described herein, the seal 200, 500 disposed in and/or under the platform trailing edge 255 can prevent hot gas from being ingested into the mateface gap 203 between the blade platforms 253. The seal 200, 500 separates the relatively high gaspath pressure just above the mateface gap 203 from the relatively low gaspath pressure just below the mateface gap 203 in the blade-vane cavity 301 which decreases component temperatures and increases lifespan of the components. Additionally, some of the cooling flow that would traditionally be used to protect and cool this region would not be necessary, thus improving thrust specific fuel consumption.

In certain embodiments, the seal 200, 500 can be utilized in a low pressure compressor, high pressure compressor, low pressure turbine, or high pressure turbine. However, it is contemplated that embodiments of a seal 200, 500 as described herein can be utilized in any suitable portion of a turbomachine, for example. While the above seal 200, 500 is disclosed as being configured for use with a trailing edge of a blade platform, it is contemplated that the seal 200, 500 can be configured for use with a trailing edge and/or leading edge of a blade and/or vane platform to minimize undesired flow between adjacent blade platforms or adjacent vane platforms.

The methods and systems of the present disclosure, as described above and shown in the drawings, provide for blade assemblies and seals with superior properties including improved thermal management. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A platform trailing edge seal for a turbomachine airfoil assembly, comprising:

a body having a first portion that reaches across a mateface gap defined between a circumferentially adjacent pair of turbomachine airfoil platforms and partially into an adjacent blade platform and a second portion that extends towards a blade root to minimize flow from entering a blade-vane cavity through an aft portion of the mateface gap, the body being shaped to match a platform trailing edge shape.

2. The seal of claim 1, wherein the body includes at least one of aluminum, titanium, or nickel.

3. The seal of claim 1, wherein the body is annular.

4. The seal of claim 1, wherein the body defines a segment of an annular structure.

5. A turbomachine blade assembly, comprising:

a blade having a blade platform which defines a platform trailing edge portion;

and a platform trailing edge seal extending from the trailing edge portion, comprising:

a retaining feature attached to a blade platform at the platform trailing edge portion configured to retain the platform trailing edge seal to the blade platform; and an annular body that engages the retaining feature and is configured to extend towards an aft portion of a mateface gap defined between the blade platform and an adjacent blade platform to minimize flow from entering a blade-vane cavity through the aft portion of the mateface gap.

6. The assembly of claim 5, wherein the platform trailing edge seal is formed integrally with the platform trailing edge.

7. The assembly of claim 5, wherein the platform trailing edge seal attached to the platform trailing edge.

8. The assembly of claim 5, wherein the body includes at least one of aluminum, titanium, or nickel.

9. The assembly of claim 5, wherein the body is shaped to match the platform trailing edge shape.

10. The assembly of claim 5, wherein the body defines a segment of an annular structure.

11. The assembly of claim 5, wherein the blade is located in one of a low pressure compressor, a high pressure compressor, a low pressure turbine, or a high pressure turbine.

12. The assembly of claim 5, wherein the platform trailing edge seal is friction fit, thermally fit, or expansion fit to the blade platform.

13. The assembly of claim 5, further including another retaining feature attached to a blade root and is configured to retain the platform trailing edge seal to the blade platform.

14. A turbomachine, comprising:

a turbomachine blade assembly, including:

a blade having a blade platform which defines a platform trailing edge portion; and a platform trailing edge seal extending from the trailing edge portion and is at least one of formed integrally with and attached to a platform trailing edge, comprising:

a body having a first portion that extends into an aft portion of a mateface gap defined between the blade platform and an adjacent blade platform and a second portion that extends towards and engages a retaining feature that is attached to a blade root to minimize flow from entering a blade-vane cavity through the aft portion of the mateface gap.

15. The turbomachine of claim 14, wherein the body includes at least one of aluminum, titanium, or nickel.

16. The turbomachine of claim 14, wherein the body is shaped to match the platform trailing edge shape.

* * * * *